United States Patent [19]

Fismen

[11] 4,056,227

[45] Nov. 1, 1977

[54] APPARATUS FOR CLEANING TANKS AND THE LIKE

[76] Inventor: Olav Håkon Fismen, Kjaernes, 1400 Ski, Norway

[21] Appl. No.: 641,747

[22] Filed: Dec. 18, 1975

[51] Int. Cl.[2] ..... B08B 3/02; B05B 3/14

[52] U.S. Cl. ..... 239/227; 134/167 R; 134/176; 134/179; 239/252; 239/256

[58] Field of Search ..... 239/227, 251, 252, 256, 239/263, 255; 134/167 R, 168 R, 176, 179, 180, 181

[56] References Cited

U.S. PATENT DOCUMENTS

| | | | |
|---|---|---|---|
| 2,784,034 | 3/1957 | Metcalf | 239/252 X |
| 3,052,574 | 9/1962 | Kennedy, Jr. | 239/252 X |

*Primary Examiner*—Evon C. Blunk
*Assistant Examiner*—Andres Kashnikow

[57] ABSTRACT

A tank cleaning device, wherein a supply tube delivers cleaning fluid into a flushing head rotatable about the tube axis and then into the nozzle of a nozzle unit mounted in the flushing head for rotation about an axis perpendicular to the tube axis, comprises a hydraulic brake cylinder coupled to the nozzle unit for variably controlling the rotational speed thereof in dependence on the rotational position of the nozzle unit. A crank couples the brake cylinder (or piston) to the shaft on which the nozzle unit is rotated for oscillating the cylinder (or piston). A mechanism couples the piston (or cylinder) to the flushing head for rotating the flushing head about the supply tube axis upon oscillation of the cylinder (or piston).

7 Claims, 2 Drawing Figures

APPARATUS FOR CLEANING TANKS AND THE LIKE

The present invention relates to an apparatus for cleaning the interior surfaces of tanks and the like, comprising a tube for introduction into the tank to supply thereinto of cleaning fluid under pressure, a flushing head which is mounted on an outlet end of the tube and is rotatable about the tube axis, a nozzle unit which is mounted on the flushing head and is rotatable about an axis essentially at right angles to the supply tube axis, which nozzle unit comprises at least one nozzle with a jet outlet direction which is offset from the rotational axis of the unit whereby the nozzle unit is rotated as a result of the reaction pressure from the delivered jet of fluid, and a hydraulic braking device which is coupled to the nozzle unit for controlling the rotational speed of the nozzle unit.

Such devices are especially intended for cleaning oil tanks on vessels. In relation to fixedly or stationarily installed tank cleaners driven from external drive units mounted on the deck of the vessel, devices of the above-mentioned type have the advantage of offering the possibility for installation deep inside the tanks while permitting operation by the flushing pressure without supervision.

By use of a hydraulic braking device which is coupled to the nozzle unit, simple control of the rotational speed of the nozzle unit is achieved. However, in known devices the rotational speed of the nozzle unit cannot be controlled or adjusted selectively in dependence of its rotational position. Further, the known devices of the above-mentioned type are complicated with respect to the mechanism for rotation of the flushing head about the supply tube axis in dependence on the rotation of the nozzle unit.

Thus, the object of the invention is to provide a tank cleaning apparatus of simple and reliable construction wherein the hydraulic braking device is arranged in such a manner that it provides for operation of the mechanism for rotation of the flushing head and simultaneously enables achievement of selected rotational speed of the nozzle unit within different flushing sectors, in order to achieve optimized cleaning fluid distribution in different directions.

The above object is achieved with an apparatus of the type set forth above, wherein, according to the invention, the hydraulic braking device is coupled to a crank device provided on the rotational axis, of the nozzle unit and is arranged to operate a mechanism for rotating the flushing head about the supply tube axis, by an oscillating movement of the braking device provided by the crank device during the rotation of the nozzle unit.

As braking device there can be used a suitable, commercially available hydraulic shock absorber. With such a "hermetic" brake, the speed of the nozzle unit will be independent of the flushing medium.

Figure 1:
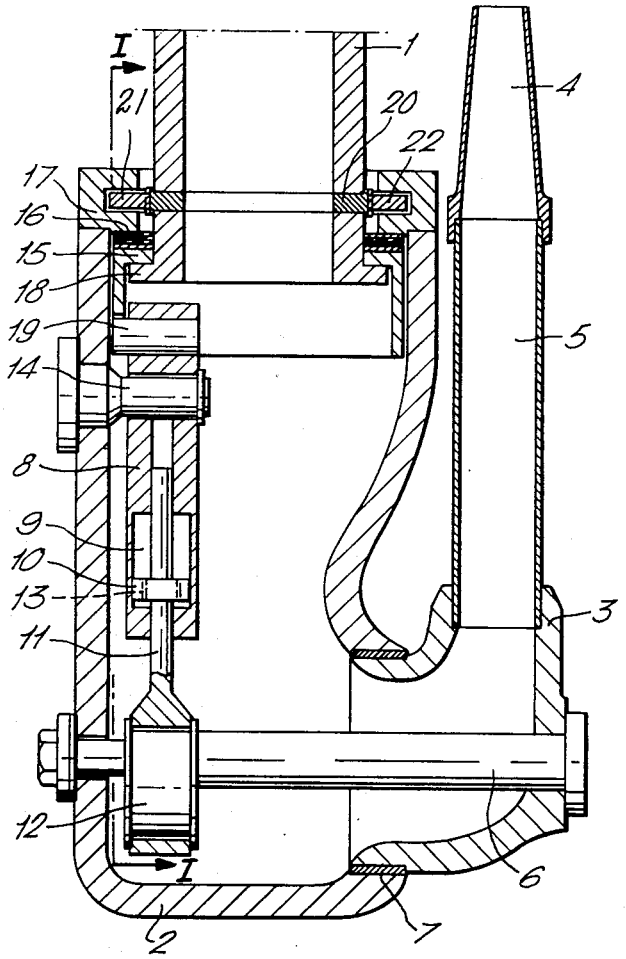
Figure 2:
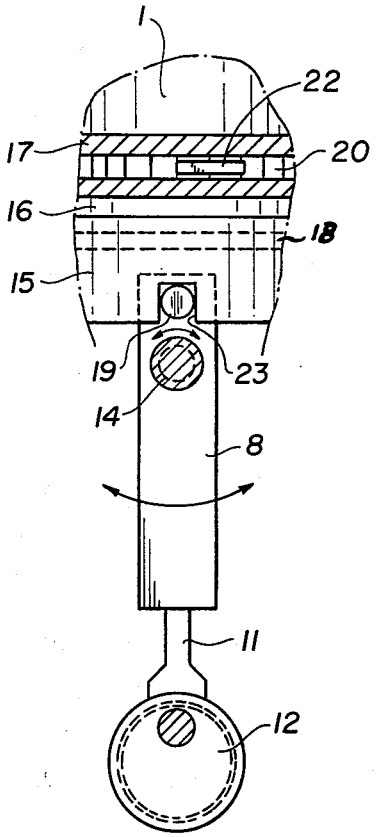

In order that the invention be more readily understood, an embodiment thereof will now be described, by way of example, with reference to the accompanying drawings wherein, FIG. 1 shows a section of an apparatus according to the invention in a plane defined by the rotational axes of the nozzle unit and the supply tube, and FIG. 2 is a fragmentary sectional view along line I-I of FIG. 1.

The tank cleaning apparatus shown in the drawing comprises essentially a supply tube 1 (partly shown), a flushing head 2 mounted at the free end of the tube 1 and being rotatable about the supply tube axis, and a nozzle unit 3 which is mounted on the flushing head and is rotatable about an axis essentially at right angles to the supply tube axis. In the shown embodiment the nozzle unit 3 includes a single nozzle 4 with a nozzle tube 5, which is offset relative to the rotational axis of the nozzle unit, in order to achieve the desired rotation of the nozzle unit as a result of the reaction pressure from the delivered jet of fluid during operation of the apparatus. The nozzle unit is mounted on shaft 6 and rotates about the axis of shaft 6 which is rotatably journalled in the flushing head and prevented, as shown, from axial displacement, the nozzle unit being journalled in the flushing head by means of a bearing lining 7 concentric with the shaft 6.

The hydraulic braking device in the embodiment shown includes a cylinder/piston assembly disposed internally of the flushing head and comprising a braking cylinder body 8 defining a braking cylinder chamber 9 wherein moves a piston 10. The braking cylinder chamber constitutes a closed cavity and contains a hydraulic fluid which is thus separated from the flushing medium itself. The piston 10 is mounted on a piston rod 11 which is coupled to the rotational shaft 6 of the nozzle unit by way of a crank 12. Thus, a reciprocating and oscillating movement of the piston 10 is achieved by rotation of the nozzle unit 3. Rotation of the flushing head about the supply tube axis is achieved by utilization of the hydraulic braking device itself. In the shown embodiment the rotation of the flushing head is achieved by the cooperation of the braking device with friction plates and with a ratchet which engages a gear ring provided on the supply tube, as described hereinbelow.

The piston 10 is provided with a throttling arrangement which may be of a known construction, such as suggested by bores 13 , and the rotational speed of the nozzle unit can be adjusted by suitably selecting the throttling bore section for varying the braking force of the hydraulic fluid in braking cylinder chamber 9, dependent on the location of the piston. In the drawing the braking cylinder chamber 9 is shown to have a cylindrical inner surface, but it is also conceivable to form this surface with varying cross-section along the path of movement of the piston.

The rotation of the flushing head is achieved by utilizing an oscillating movement of the braking cylinder body 8 indicated by the double-headed arrows in FIG. 2. This oscillating movement is generated as a result of the shown interconnection between the rigid piston rod 11 and crank member 12, the braking cylinder body 8 being pivotally connected to the wall of the flushing head 2 by means of a pivot axle 14. The arrangement for rotating the flushing head includes a pair of friction plates 15 and 16 which, as shown, is arranged between an upper flange 17 on the flushing head 2 and a flange 18 on the supply tube 1. The friction plates are arranged in order to absorb the moment of reaction which is exerted on the flushing head about the supply tube axis by the reaction force of the nozzle jet. In the shown construction three friction faces couple the flushing head and the supply tube. The first or lower friction plate 15 absorbs 2/3 of the holding moment, whereas the flange of the flushing head absorbs 1/3. For retention of the flushing head 2 against axial displacement on the supply tube 1, a suitable blocking ring (not shown) may be disposed on the supply tube above the flange of the flushing head.

The upper end portion of the braking cylinder body 8 is coupled to the lower friction plate 15 by pin 19 fixed to the body 8 and projecting into vertical guide slot 23 in a downwardly extending skirt member on the friction plate. By means of this construction the lower friction plate 15 is given a forced oscillation or angle rotation, controlled by the oscillating movement of the braking cylinder by the rotation of the nozzle unit. By oscillation of braking cylinder 8 direction i.e. in the direction of rotation of the flushing head the lower friction plate 15 is retained between the flange 18 of the supply tube and the upper friction plate 16 which is secured against rotation on the supply tube 1 by means of a suitable, locking device (not shown). Thus the flushing head is rotated on the supply tube an angle which can be adjusted at will by selection of a suitable distance between the pins 14 and 19. When the braking cylinder oscillates in the opposite direction, the flushing head 2 is retained relative to the supply tube 1 by means of a ratchet mechanism which in the shown embodiment includes ratchets or pawls 21, 22 arranged in upper flange 17 of the flushing head and engaging a ratchet wheel or gear ring 20 on the supply tube 1. As the flushing head in the latter case is retained against rotation, the lower friction plate will slide back an angle corresponding to the above-mentioned angle of rotation of the flushing head.

The ratchet mechanism preferably includes several pawls engaging the same ratchet wheel in order to be able to give a finely divided flushing pattern with low load on pawls and ratchet wheels by large teeth and low surface pressure.

In double jet cleaning devices, wherein the reaction forces of the jets can be directed oppositely and provide a pure turning moment, and possibly when single jet devices can be held by means of one friction surface, the two above-mentioned friction plates may be omitted. The oscillating movement of the braking device can then be transferred directly to a ratchet mechanism which is in engagement with the flange of the supply tube.

What I claim is:

1. An apparatus for cleaning the interior surfaces of a tank and the like, which comprises a. a supply tube having an outlet end for introducing a supply of a cleaning fluid under pressure into the tank, b. a flushing head mounted on the outlet end of the supply tube for receiving the cleaning fluid therefrom and for rotation about the axis of the tube, c. a nozzle unit mounted in the flushing head for rotation about an axis substantially perpendicular to the tube axis, the nozzle unit including 1.a shaft mounting the nozzle unit rotatably in the flushing head for rotation about the shaft and 2. a nozzle in communication with the flushing head for receiving the cleaning fluid therefrom, the nozzle having a jet outlet direction offset from the axis of rotation of the nozzle unit whereby the nozzle unit is rotated as a result of reaction pressure from a jet of cleaning fluid delivered through the nozzle, d. a hydraulic braking device coupled to the nozzle unit for variably controlling the rotational speed of the nozzle unit in dependence on the rotational position of the nozzle unit, the braking device comprising 1. two members reciprocable relative to each other and 2. means for varying the braking force of the device in dependence on the relative position of the two members whereby the rotational speed of the nozzle unit is variably controlled, e. a crank coupling one of the members of the braking device to the shaft of the nozzle unit for oscillating the braking device about an axis parallel to the axis of the shaft, and f. a mechanism coupling the other braking device member to the flushing head for rotating the flushing head about the axis of the supply tube upon oscillation of the braking device.

2. The apparatus of claim 1, wherein one of the braking device members is a cylinder defining a chamber containing a hydraulic fluid and the other braking device member is a piston reciprocable in the cylinder chamber, and means in the piston for varying the braking force of the hydraulic fluid.

3. The apparatus of claim 2, wherein the piston is coupled to the crank and the cylinder is mounted in the flushing head for oscillating pivoting movement about an axis substantially parallel to the axis of the shaft, rotation of the shaft causing the oscillating movement of the cylinder, and further comprising a pivot axle mounting the braking device cylinder for oscilating movement in the flushing head.

4. The apparatus of claim 3, wherein the mechanism for rotating the flushing head comprises a ratchet wheel on the supply tube and pawl means for engagement with the ratchet wheel coupled to the oscillating cylinder.

5. The apparatus of claim 4, wherein the mechanism for rotating the flushing head further comprises a flange on the supply tube, a flange on the flushing head, a pair of friction plates arranged between the flanges, means coupling the braking device cylinder to one of the friction plates, and the other friction plate being fixedly secured to the supply tube whereby, when the braking device cylinder oscillates in one direction, the one friction plate is held stationarily between the flange on the supply tube and the other friction plate to cause rotation of the flushing head, and oscillation of the braking device cylinder in the other direction causes the coupling means to move the one friction plate relatively to the supply tube, the ratchet wheel and pawl means retaining the flushing head against rotation about the supply tube.

6. The apparatus of claim 5, wherein the coupling means comprises a pin affixed to the braking device cylinder, the one friction plate having a skirt defining a guide slot wherein the pin is engaged whereby oscillating movement of the cylinder causes the pin to entrain the one friction plate.

7. The apparatus of claim 2, wherein the means in the piston for varying the braking force of the hydraulic fluid comprises throttling bores in the piston permitting flow of the hydraulic fluid therethrough.

* * * * *